US012016373B2

(12) United States Patent
Van Den Boogaart

(10) Patent No.: US 12,016,373 B2
(45) Date of Patent: Jun. 25, 2024

(54) CASTING APPARATUS AND A METHOD FOR PRODUCING A CAST WEB OF A MATERIAL CONTAINING ALKALOIDS

(71) Applicant: PHILIP MORRIS PRODUCTS S.A., Neuchatel (CH)

(72) Inventor: Marc A. F. Van Den Boogaart, Giez (CH)

(73) Assignee: Philip Morris Products S.A., Neuchatel (CH)

( * ) Notice: Subject to any disclaimer, the term of this patent is extended or adjusted under 35 U.S.C. 154(b) by 595 days.

(21) Appl. No.: 17/252,350

(22) PCT Filed: Jun. 28, 2019

(86) PCT No.: PCT/EP2019/067431
§ 371 (c)(1),
(2) Date: Dec. 15, 2020

(87) PCT Pub. No.: WO2020/002652
PCT Pub. Date: Jan. 2, 2020

(65) Prior Publication Data

US 2021/0267259 A1 Sep. 2, 2021

(30) Foreign Application Priority Data

Jun. 29, 2018 (EP) ..... 18181018

(51) Int. Cl.
*A24B 3/14* (2006.01)
*A24B 15/14* (2006.01)
*A24C 5/01* (2020.01)

(52) U.S. Cl.
CPC ..... *A24B 3/14* (2013.01); *A24C 5/01* (2020.01); *A24B 15/14* (2013.01)

(58) Field of Classification Search
CPC ..... A24B 3/14; A24B 15/14; A24C 5/01
See application file for complete search history.

(56) References Cited

U.S. PATENT DOCUMENTS 4,047,536 A 9/1977 Asfour
4,724,850 A * 2/1988 Graves, Jr. ..... A24B 3/14 131/370

(Continued)

FOREIGN PATENT DOCUMENTS

GB 899 565 6/1962
JP S51-012999 1/1976

(Continued)

OTHER PUBLICATIONS

Search Report and Written Opinion for PCT/EP2019/067431 dated Sep. 25, 2019 (14 pages).

(Continued)

*Primary Examiner* — Christopher M Rodd
*Assistant Examiner* — Jennifer A Kessie
(74) *Attorney, Agent, or Firm* — Mueting Raasch Group

(57) ABSTRACT

The present invention is related to a casting apparatus (100) for the production of a cast web of a material containing alkaloids, said casting apparatus (100) including: •—a casting box (101) adapted to contain a slurry; •—a movable support (102) having a surface and moving along a casting direction; •—a casting blade (103), adapted to cast the slurry contained in the casting box (101) onto the surface of the movable support (102) along the casting direction so as to form the cast web of a material containing alkaloids; wherein the casting blade (103) includes a corrugated portion. The invention also relates to a casting method for producing a cast web of a material containing alkaloids and to cast a web of a material containing alkaloids from said method.

15 Claims, 3 Drawing Sheets

(56) References Cited

U.S. PATENT DOCUMENTS

| | | | |
|---|---|---|---|
| 4,730,629 | A | 3/1988 | Graves, Jr. |
| 10,575,549 | B2 | 3/2020 | Soo |
| 10,881,118 | B2 | 1/2021 | Guttapadu |
| 2003/0209027 | A1 | 11/2003 | Owens |
| 2017/0340002 | A1 | 11/2017 | Soo |

FOREIGN PATENT DOCUMENTS

| | | |
|---|---|---|
| JP | S62-220182 | 9/1987 |
| JP | 2005-524405 | 5/2005 |
| JP | 2017-524368 | 8/2017 |
| JP | 2018-500017 | 1/2018 |
| JP | 2018-504090 | 2/2018 |
| WO | WO 2016/096963 | 6/2016 |
| WO | WO 2017/089589 | 6/2017 |

OTHER PUBLICATIONS

Office Action issued in Japan for Application No. 2020-567899 dated May 22, 2023 (6 pages). English translation included.

* cited by examiner

CASTING APPARATUS AND A METHOD FOR PRODUCING A CAST WEB OF A MATERIAL CONTAINING ALKALOIDS

This application is a U.S. National Stage Application of International Application No. PCT/EP2019/067431 filed Jun. 28, 2019, which was published in English on Jan. 2, 2020 as International Publication No. WO 2020/002652 A1. International Application No. PCT/EP2019/067431 claims priority to European Application No. 18181018.5 filed Jun. 29, 2018.

The invention concerns a casting apparatus and a method for producing a cast web of a material containing alkaloids.

Typically, aerosol-generating articles comprise a plurality of elements assembled in the form of a rod. The plurality of elements generally includes an aerosol-forming substrate and a filter element. One or both of the filter and the aerosol-forming substrate may comprise a plurality of channels to provide air-flow through the rod.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The starting material for the production of homogenized tobacco material for aerosol-generating article may also be mostly tobacco leaves that have thus the same size and physical properties as the tobacco for the blending of cut filler.

Possible forms of homogenized tobacco material include reconstituted tobacco sheet and cast leaf. The process to form homogenized tobacco material sheets commonly comprises a step in which ground tobacco and a binder are mixed to form a slurry. The slurry may then be used to create a tobacco web or sheet by casting a viscous slurry with a casting blade onto a moving metal belt to produce a continuous sheet which is driven by the belt into heating units where temperature is controlled to progressively heat and dry homogeneously the same sheet. The sheet thus obtained is then typically wind up into bobbins for storage. These bobbins are later unwound and used to create the tobacco component used into the smoking articles.

During the casting process, variations in the physical properties of the slurry, for example, consistency, viscosity, fibre size, particle size, moisture or the age of the slurry, may result in unintended variations in the application of the slurry onto a support during the casting of webs of homogenized tobacco. A less than optimal casting method and apparatus may lead to undesired inhomogeneity, defects, tearing or even rupture of the cast web of homogenized tobacco, to undesired variations of its thickness and to difficulties in subsequent handling or further processing of the same homogenized tobacco web in the production of the aerosol-generating article.

For example, the particle size of the slurry may vary in dimension and particles of greater size may cause a blockage of the casting process, for example due to the formation of an obstruction during the casting process, which may prevent the formation of a homogeneous cast sheet and thus may impair the properties of the same.

Undesired inhomogeneity, defects, tearing or rupture could, for example, result in machine stops and the inadvertent creation of waste. Additionally, an inhomogeneous tobacco web may create unintended difference in the aerosol delivery between aerosol generating articles that are produced from the same homogenized tobacco web.

Also, a non-optimal, a sub-optimal, or a varying thickness of the web could adversely influence the following production steps, such as a crimping step, and could deteriorate the release of substances from the crimped sheet of material to the air penetrating the rod, as well as adversely affect the resistance to draw (RTD) value.

Furthermore, undesired inhomogeneity, and defects of the web may render difficult also the unwinding of the bobbins including windings of the same web. The homogenized tobacco material web, when coiled in bobbins, may be indeed difficult to unwind due to its consistency, sensitivity to heat, stickiness and low tensile strength that may be intensified by undesired inhomogeneity or defects: it could easily be torn apart and, if too high force is used to un-stuck the sheets, the web could break.

There is therefore a need of a casting apparatus and a method for producing a cast web of a material containing alkaloids, such as homogenized tobacco material, that is capable of providing a cast web with improved properties of homogeneity, integrity as well as improved mechanical properties, without undesired variations of thickness and that is easily handled and transported, in particular when needed, and that therefore allows providing a continuous, constant and regular feed of material so that the rest of the production line can increase the overall production rate.

The invention may satisfy at least one of the above needs.

According to a first aspect, the invention relates to a casting apparatus for the production of a cast web of a material containing alkaloids, said casting apparatus including: a casting box adapted to contain a slurry; a movable support having a surface and moving along a casting direction; a casting blade, adapted to cast the slurry contained in the casting box onto the surface of the movable support along the casting direction so as to form the cast web of a material containing alkaloids; wherein the casting blade includes a corrugated portion.

The casting apparatus of the invention includes a casting box, adapted to contain a slurry, a movable support and a casting blade including a corrugated portion. The slurry comprises a material containing alkaloids and is cast onto a surface of the movable support along a casting direction by the casting blade. During the casting, an edge of the casting blade that comes into contact with the slurry forms a gap with the surface of the movable support and the slurry passes through said gap, falling onto the movable support. Due to the corrugated portion of the blade present preferably at the edge, the slurry passing through it may be gathered and driven by the corrugations in a specific optimal way.

As used herein, the terms "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters. A continuous "sheet" is herein called "web".

As used herein, the term "aperture" denotes any type of a single or a plurality of openings that are provided for the passage of a liquid-like, viscous or pasty substance, such as the slurry. The aperture may have a comparatively long length and a comparatively small width.

As used herein, the term "casting blade" denotes a longitudinally shaped element that may have an essentially constant cross-section along major parts of its lengthwise extension. It preferably includes at least one edge that is intended to come into contact with a pasty, viscous or liquid-like substance, such as a slurry. The slurry is cast and, to a certain extent, shaped by said edge. Said edge may have a sharp and knife-like shape. Alternatively, it may have a rectangular or a rounded shape.

As used herein, the term "blunt portion" denotes a portion of the edge of the casting blade having a rounded shape. That is, a blunt portion defines along a cross-section of the blade's edge parallel to the casting direction an arc of circumference having a predetermined radius of curvature.

As used herein, the term "movable support" denotes any means comprising a surface that can be moved in at least one longitudinal direction. However, the movable support may be moved in a back and forth movement as well. The movable support may include a conveyor belt. The movable support may be essentially flat and may show a structured or an unstructured surface. The movable support may show no openings in its surface or may show only orifices of such a size that they are impenetrable for the slurry deposited on it. The movable support may comprise a sheet-like movable and bendable band. The band may be made of a metallic material, including but not limited to steel, copper, iron alloys and copper alloys, or of a rubber material. The band may be made of a temperature-resistant material so that it can be heated to speed up the drying process of the slurry.

As used herein, the term "slurry" denotes a liquid-like, viscous or pasty material that may comprise an emulsion of different liquid-like, viscous or pasty material and that may contain a certain amount of solid-state particles, provided that the slurry still shows a liquid-like, viscous or pasty behaviour, at least in the vicinity of the aperture defined by the gap between the surface of the movable support and the casting blade.

As used herein, when referred to the casting apparatus, the expression "ridges" denotes a plurality of protrusions alternatively extending outwardly in a direction orthogonal to the surface from which the same protrudes.

As used herein, when referred to the casting apparatus, the expression "troughs" denotes a plurality of protrusions alternatively extending inwardly in a direction orthogonal to the surface from which the same protrudes.

Typically, ridges and troughs may alternate each other on the surface of the blade thus forming a pair, defining a tip and a bottom that may be either of a corner-type shape or of a rounded shape. For example, when a plurality of ridges and troughs alternate each other on the surface of a blade edge, the same may show a wavy profile, when observed in a direction parallel to the surface.

As used herein, the term "amplitude value" or "amplitude" denotes the distance between the lowermost and the uppermost point of the ridges or troughs in a direction orthogonal to a dominant dimension of the casting blade and to the casting direction. For example, in the casting blade including a plurality of ridges and troughs, the amplitude denotes the distance between the uppermost point of the ridges and the lowermost point of the paired troughs in a direction orthogonal to a dominant dimension of the casting blade and to the casting direction.

As used herein, the term "pitch value" or "pitch" denotes the distance between two consecutive ridges in a direction parallel to a dominant dimension of the casting blade. It may denote the distance between two consecutive tips.

As used herein, the term "rod" denotes a generally cylindrical element of substantially circular or oval cross-section.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein, the term "homogenised tobacco material" denotes material formed by agglomerating particulate tobacco, which contains the alkaloid nicotine. The material containing alkaloids can thus be a homogenized tobacco material.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The homogenized tobacco sheet material can be also referred to as a reconstituted sheet material and formed using particulate tobacco (for example, reconstituted tobacco) or a tobacco particulate blend, a humectant and an aqueous solvent to form the tobacco composition. This tobacco composition may be then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The homogenized tobacco sheet generally includes, in addition to the tobacco, a binder and an aerosol-former, such as guar and glycerin. This composition leads to a sheet which may be "sticky", that is, it glues to adjacent objects, and at the same time it is rather fragile having a relatively low tensile strength.

The sheet or web of homogenized tobacco material may be then rolled in bobbins which need to be unwound in order to be further processed, to be part for example of an aerosol-forming article, that is to be included in the aerosol-forming substrate of the aerosol-forming article.

As used herein, the term "aerosol forming material" denotes a material that is capable of releasing volatile compounds upon heating to generate an aerosol. Tobacco, together with other compounds, may be classified as an aerosol forming material, particularly a sheet of homogenized tobacco comprising an aerosol former. An aerosol forming substrate may comprise or consist of an aerosol forming material. The homogenized tobacco sheet can be used as an aerosol forming material.

The casting apparatus of the invention includes a casting box, adapted to contain a slurry, a movable support and a casting blade. The movable support defines a surface. Preferably, the surface is horizontal. Preferably, the surface is planar.

The slurry is cast onto the surface of the movable support along a casting direction by the casting blade. A cast web is thus thereby formed.

The blade is preferably arranged perpendicular to the casting direction. The slurry from the casting box comes into contact with the casting blade. The casting blade defines an edge, for example a lower edge, preferably facing the movable support and more preferably the surface on which the slurry is cast. The edge of the casting blade forms a gap with the surface of the movable support and the slurry passes through the gap. Thus, the thickness of the cast web of material may be determined by the distance between the edge of the casting blade and the surface of the movable support, that is, by the gap's dimension.

In the apparatus of the invention, the casting blade includes a corrugated portion. The slurry therefore, exiting the casting box, during the casting, enters into contact with this corrugated portion. Being the portion of the blade corrugated, it forms a gap having a variable dimension along its extension, that is, the distance between the blade's edge and the surface of the movable support may change. The corrugated portion may have one or more of the following effects. Particles of different sizes which may be contained in the slurry passing through the corrugation and the gap may be gathered in different positions and driven differently by the corrugations of the blade. In this way, even if the slurry contains particles of dimensions greater than the dimension of the gap in a certain location, thus in principle blocking the flow of slurry, due to the corrugated shape, the particle can be driven to a—wider—different portion of the gap, so that the slurry can flow below the blade. Thus, blockages of the casting process may be avoided, for example minimizing the formation of obstructions or tearing of the web. The casting process is thus possibly facilitated and improved in terms of homogeneity, integrity, and mechanical properties of the web.

The step of producing a bobbin, or a crimping step, may be also possibly facilitated in view of the improved properties of said web. For example, the improved homogeneity, integrity and mechanical properties of the web may allow applying a force having a relatively high magnitude in an unwinding step with a reduced risk of rupture of the web. When the web is wound in a bobbin, the corrugations formed in the web by the corrugated portion of the blade reduce the contact surface between two layers of the web in contact to each other in the bobbin. This reduces the "adhesion" and allows an easier unwinding. Also, the corrugations formed in the cast sheet form channels in the final product, which could improve the release of substances from the crimped sheet of material to the air penetrating the rod, as well as favourably affect the RTD value.

In this way, the users' smoking experience of the aerosol generated from the web of homogenized tobacco material of the aerosol-forming substrate may be possibly improved in view of the improved properties of the web.

Preferably, the corrugated portion of the casting blade faces the surface of the movable support.

The corrugated portion may advantageously apply a pattern on a surface of the web cast onto the movable support. The web including the material containing alkaloids so obtained may then show a pattern with protrusions, even after drying. When said web is wound up into a bobbin comprising a plurality of layers one above the others, the adhesion between two consecutive layers may be reduced by the presence of said pattern that limits the amount of surface contact between the layers. Unwinding of the bobbin may be easier than in case of non-patterned webs.

Preferably, the corrugated portion includes ridges or troughs. Preferably, the ridges or troughs extend in a direction orthogonal to a dominant dimension of the casting blade. Preferably, the ridges or troughs extend along the casting direction.

A ridge or a trough extends along a given direction when the highest point or the lowest point of the ridge or trough follows such a given direction. The highest or lowest point is thus substantially a line along a given direction.

Preferably, an amplitude of the ridges is variable along the casting direction. More preferably, the amplitude of the ridges monotonously increases along the casting direction. In this way, during casting, the slurry coming into contact with the corrugated portion of the blade may then advantageously be gathered and driven when passing through the passage defined by the gap between the casting blade and the surface of the movable support. This may reduce the occurrence of obstructions that may block the casting process or cause tearing of the cast web. The indicated configuration creates narrowing channels that for example may gather possible draggers into these areas of highest points of the profile and helps them exiting without creating tearing or weakness in the cast web.

Preferably, the ridges or troughs have a pitch comprised between about 0.2 millimeters and about 4 millimeters, preferably comprised between about 0.3 millimeters and about 2 millimeters, more preferably between about 0.5 millimeters and about 1.5 millimeters.

This pitch has proven to be optimal to obtain the desired characteristics of the casting apparatus. For example, the desired gathering and driving the slurry is thereby obtained.

As used herein, when referred to the cast web the term "pitch value" or "pitch" denotes the distance of two consecutive protrusions, for example two consecutive ridges or troughs, taken along a direction orthogonal to the thickness of the cast web.

Preferably, a distance between a lowest point of the corrugated portion of the casting blade and the surface of the movable support facing the casting blade decreases along the casting direction. The blade is thus closer to the movable support in a downstream portion than in an upstream portion.

Preferably, the blade includes a first and a second edge, the second edge being downstream the first edge in the direction of casting. Preferably, the first edge is substantially flat, that is, it does not include any corrugation. Preferably, the second edge is sinusoidal, that is, it includes a sinusoid. Preferably, in any cross section of the blade taken along any plane between the first and the second edge, the blade defines an edge in such cross section which includes a sinusoid having a smaller amplitude than the sinusoid present in the second edge.

Preferably, the corrugated portion defines a plurality of channels extending along the casting direction.

Preferably, a depth of the channels increases along the casting direction.

Preferably, a width of the channels decreases along the casting direction. Preferably, the width of the channel is defined in a direction perpendicular to the casting direction.

In this way, during casting, the presence of these channels facilitates the flow of the slurry, thus possibly facilitating the casting process, for example by reducing the occurrence of obstructions that may block the casting process or cause tearing of the cast web.

Preferably, the casting blade defines a dominant dimension and the casting blade is movable along the dominant dimension. Preferably, the dominant dimension is defined in a direction perpendicular to the casting direction. Preferably, the movement can be performed thanks to an actuator, which is adapted to change the position of the casting blade along a direction parallel to a dominant dimension of the casting blade.

According to a second aspect, the invention relates to a method for producing a cast web of a material containing alkaloids, comprising: providing a slurry of the material containing alkaloids; feeding the slurry to a casting box adapted to contain the slurry; casting the slurry contained in the casting box by means of a casting blade along a casting direction onto a movable support so as to form the cast web of a material containing alkaloids, wherein the casting blade includes a corrugated portion facing a surface of the movable support; forming a plurality of corrugations onto the cast web by means of the corrugated portion of the casting blade.

The advantages of the second aspect have been already outlined with reference to the first aspect and are not repeated herewith.

Preferably, the step of forming the plurality of corrugations includes forming a plurality of ridges or troughs. Preferably, the ridges or troughs extend in a direction parallel to the casting direction.

In this way, a desired pattern including a plurality of ridges or troughs may be applied onto the surface of the cast web. The web including the material containing alkaloids thus obtained may then show a desired pattern, even after drying. When said web is wound up into a bobbin comprising a plurality of layers of the same web one above the others, the adhesion between two consecutive layers may be then reduced by the presence of said pattern that limits the amount of surface contact between the layers.

At the same time, the plurality of ridges or troughs formed onto the web of a material containing alkaloids may contribute to influence the flow of air through the aerosol-generating article and in this way a desired contact between the air and the material containing alkaloids included in the aerosol-forming substrate may be obtained. The users' smoking experience of the aerosol generated from the homogenized tobacco material of the aerosol-forming substrate is thus possibly improved.

Preferably, the method for producing a cast web of a material containing alkaloids of the invention includes: changing a position of the casting blade along a direction orthogonal to the casting direction.

Preferably, the step of changing the position of the casting blade incudes: changing the position of the casting blade along a direction parallel to a dominant dimension of the casting blade.

The thickness of the cast web and the pattern of the corrugations onto the same may be controlled and modified during the casting process. For example, by an alternated movement of a casting blade along a direction parallel to a dominant dimension of the casting blade, a "wavy" pattern may be applied on the cast web, when the casting blade includes a corrugated portion with a plurality of ridges or troughs. Changing the position of the casting blade along a direction parallel to a dominant dimension of the casting blade allows changing the dimension of the gap between the casting blade and the movable support. The direction orthogonal to the casting direction is preferably also orthogonal to the movable support's surface.

According to a third aspect, the invention relates to a web of a material containing alkaloids having a free surface including a corrugated portion, wherein the corrugated portion includes ridges or troughs extending in a direction orthogonal to the thickness of the web and having a pitch comprised between about 0.2 millimeters and about 2 millimeters and wherein the web has a water content comprised from about 20 percent to about 80 percent by weight of the web.

The advantages of the third aspect have been already outlined with reference to the first and second aspects and are not repeated herewith.

Preferably, the web has a water content comprised from about 60 percent to about 80 percent by weight of the web, more preferably from about 30 percent to about 70 percent by weight of the web.

Preferably, the corrugated portion includes ridges or troughs extending in a direction orthogonal to the thickness of the web.

Preferably, in the web of the invention, the ridges or troughs have a pitch comprised between about 0.3 millimeters and about 1.7 millimeters, more preferably between about 0.5 millimeters and about 1.5 millimeters.

Preferably, in the web of a material containing alkaloids, the corrugated portion includes ridges or troughs extending in a direction parallel to a length of the web.

The web of the invention may be further processed and included in an aerosol-generating article component for producing an aerosol forming article.

Aerosol forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material without combustion or heating.

Aerosol forming articles according to the invention may be whole, assembled aerosol forming articles or components of aerosol forming articles that are combined with one or more other components in order to provide an assembled article for producing an aerosol, such as for example, the consumable part of a heated smoking device.

An aerosol forming article may be an article that generates an aerosol that is directly inhalable into a user's lungs through the user's mouth. An aerosol forming article may resemble a conventional smoking article, such as a cigarette and may comprise tobacco. An aerosol forming article may be disposable. An aerosol forming article may alternatively be partially-reusable and comprise a replenisheable or replaceable aerosol forming substrate.

An aerosol forming article may also include a combustible cigarette. In preferred embodiments, the aerosol forming-article may be substantially cylindrical in shape. The aerosol forming article may be substantially elongated. The aerosol forming article may have a length and a circumference substantially perpendicular to the length. The aerosol forming article may have a total length between approximately about 30 millimeters and approximately about 100 millimeters. The aerosol forming article may have an external diameter between approximately about 4 millimeters and approximately about 12 millimeters.

In all the aspects of the invention, preferably, the web of a material containing alkaloids is a homogenized tobacco web, where the material containing alkaloids is tobacco containing nicotine.

The homogenized tobacco web includes tobacco particles grinded from tobacco leaves (for example tobacco stem and lamina).

The homogenized tobacco web may also comprise a minor quantity of one or more of tobacco dust, tobacco fines, and other particulate tobacco by-products formed during the treating, handling and shipping of tobacco.

The tobacco present in the homogenized tobacco material may constitute the majority of the tobacco, or even substantially the total amount of tobacco present in the aerosol-generating article. The impact on the characteristics of the aerosol, such as its flavour, may derive predominantly from the homogenized tobacco material. It is preferred that the release of substances from the tobacco present in the homogenized tobacco material is simplified, in order to optimize use of tobacco. In the following, the term "tobacco particles" is used through the specification to indicate tobacco having a mean size per weight between about 0.03 millimetres and about 0.12 millimetres.

Tobacco particles having a mean particle size by weight between about 0.03 millimetres and about 0.12 millimetres may improve the homogeneity of the slurry. The quantity of binder added to the blend of one or more tobacco types is preferably comprised between about 1 percent and about 5 percent in dry weight of the slurry. The binder used in the slurry may be any of the gums or pectins described herein. The binder may ensure that the tobacco powder remains substantially dispersed throughout the homogenized tobacco web. For a descriptive review of gums, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

The homogenized tobacco material comprises preferably between about 45 percent and about 93 percent in dry weight basis of tobacco particles.

Preferably, the homogenized tobacco sheet also includes a binder.

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Preferably, binder is in an amount comprised between about 1 percent and about 5 percent in dry weight basis of the homogenized tobacco web. More preferably, it is comprised between about 2 percent and about 4 percent.

Preferably, the homogenized tobacco web also includes cellulose fibers, in addition to the cellulose fibers already present in the tobacco.

Cellulose fibres may be introduced in the slurry. The introduction of cellulose fibres in the slurry typically increases the tensile strength of the tobacco material web, acting as a strengthening agent. Therefore, adding cellulose fibres may increase the resilience of the homogenized tobacco material web.

Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof.

Cellulose fibres may include tobacco stem materials, stalks or other tobacco plant material. Preferably, cellulose fibres such as wood fibres comprise a low lignin content. Alternatively fibres, such as vegetable fibres, may be used either with the above fibres or in the alternative, including hemp and bamboo.

The length of cellulose fibres is advantageously between about 0.2 millimetres and about 4 millimetres. Preferably, the mean length per weight of the cellulose fibres is between about 1 millimetre and about 3 millimetres.

Further, preferably, the amount of the cellulose fibres is comprised between about 1 percent and about 7 percent in dry weight basis of the total weight of the slurry (or homogenized tobacco web).

Advantageously, the method comprises the step of adding an aerosol-former to the slurry. Suitable aerosol-formers for inclusion in slurry for homogenised tobacco material are known in the art and include, but are not limited to: monohydric alcohols like menthol, polyhydric alcohols, such as triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol-formers are glycerin and propylene glycol.

The homogenized tobacco material may have an aerosol-former content of greater than about 5 percent on a dry weight basis. The homogenized tobacco material may alternatively have an aerosol former content of between about 5 percent and about 30 percent by weight on a dry weight basis. More preferably, the aerosol-former is comprised between about 10 percent to about 25 percent of dry weight of the homogenized tobacco material. More preferably, the aerosol-former is comprised between about 15 percent to about 25 percent of dry weight of the homogenized tobacco material.

The binder and the cellulose fibers are preferably included in a weight ratio comprised between about 1:7 and about 5:1. More preferably, the binder and the cellulose fibers are included in a weight ratio comprised between about 1:1 and about 3:1.

The binder and the aerosol-former are preferably included in a weight ratio comprised between about 1:30 and about 1:1. More preferably, the binder and the aerosol-former are included in a weight ratio comprised between about 1:20 and about 1:4.

The binder and the tobacco particles are preferably included in a weight ratio comprised between about 1:100 and about 1:10. More preferably, the binder and the tobacco particles are included in a weight ratio comprised between about 1:50 and about 1:15, even more preferably between about 1:30 and 1:20.

The aerosol-former and the tobacco particles are preferably included in a weight ratio comprised between about 1:20 and about 1:1. More preferably, the aerosol-former and the tobacco particles are included in a weight ratio comprised between about 1:6 and about 1:2.

The aerosol former and the cellulose fibres are preferably included in a weight ratio comprised between about 1:1 and about 30:1. More preferably, the aerosol-former and the cellulose fibres are included in a weight ratio comprised between about 5:1 and about 15:1.

The cellulose fibres and the tobacco particles are preferably included in a weight ratio comprised between about 1:100 and about 1:10. More preferably, the cellulose fibres and the tobacco particles are preferably included in a weight ratio comprised between about 1:50 and about 1:20.

The above mentioned weight ratios of the ingredients of the homogenized tobacco web are applicable not only to the homogenized tobacco web, but also they are the weight ratios of the various ingredients present in the slurry.

Preferably, the cast web is dried to form a web of homogenized tobacco material and it is then removed from the support surface.

The invention may also relate to a casting apparatus for the production of a cast web, said casting apparatus including a casting box adapted to contain a slurry; a movable support having a surface and moving along a casting direction; a casting blade, adapted to cast the slurry contained in the casting box onto the surface of the movable support along the casting direction so as to form the cast web of a material containing alkaloids; wherein the casting blade includes a corrugated portion.

The invention may also relate to a method for producing a cast web, comprising providing a slurry of the material containing alkaloids; feeding the slurry to a casting box adapted to contain the slurry; casting the slurry contained in the casting box by means of a casting blade along a casting direction onto a movable support so as to form the cast web of a material containing alkaloids, wherein the casting blade includes a corrugated portion facing a surface of the movable support; and forming a plurality of corrugations onto the cast web by means of the corrugated portion of the casting blade.

The invention may also relate to a web of a material containing alkaloids having a free surface including a corrugated portion, wherein the corrugated portion includes ridges or troughs extending in a direction orthogonal to a thickness of the web, having a pitch comprised between about 0.2 millimeters and about 2 millimeters and wherein the web has a water content comprised from about 20 percent to about 80 percent by weight of the web.

Specific embodiments of the invention will be further described, by way of example only, with reference to the accompanying drawings in which.

Figure 1:
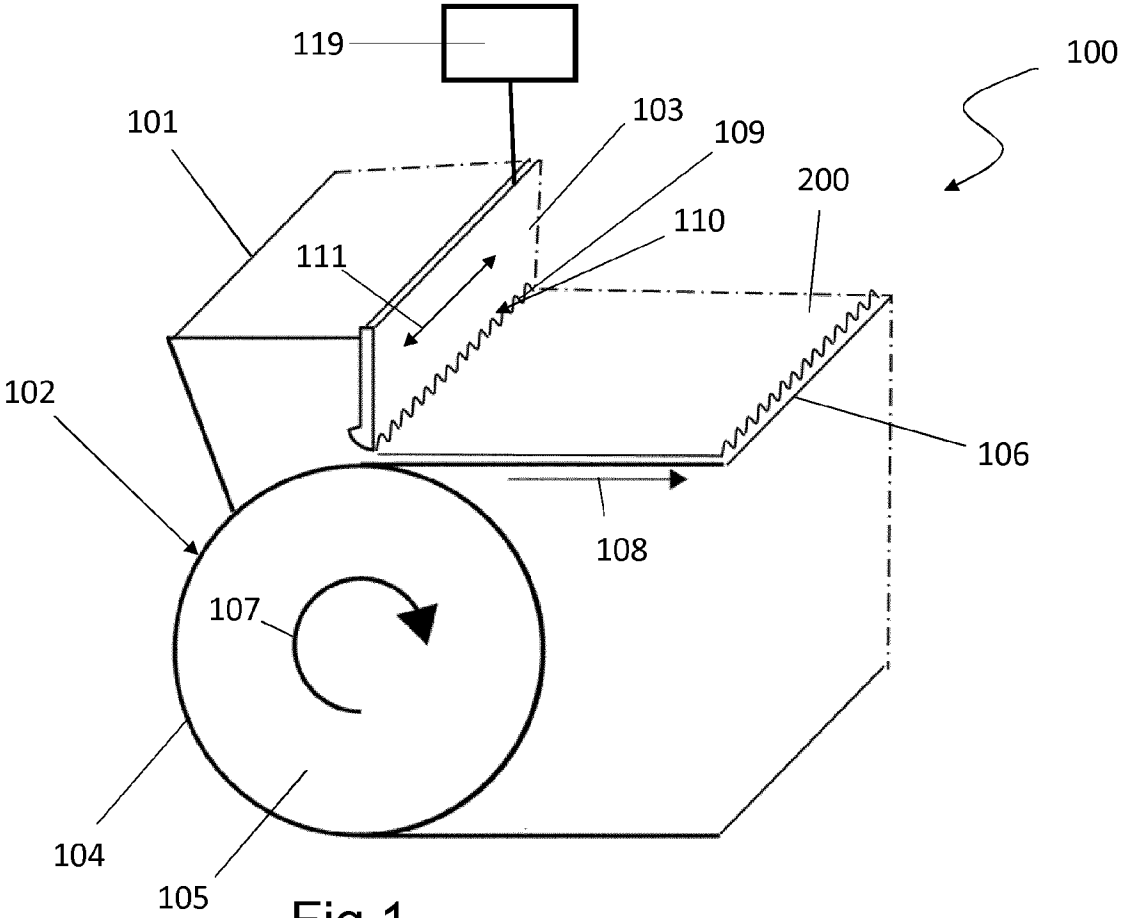
FIG. 1 is a perspective schematic partial view of an apparatus for the production of a cast web of a material containing alkaloids.

With initial reference to FIG. 1, a perspective schematic partial view of an apparatus 100 for the production of a cast web 200 of a material containing alkaloids is shown.

Preferably, but not necessarily, the apparatus 100 puts in operation the method of the invention described with reference to FIG. 6.

Apparatus 100 includes a casting box 101 adapted to contain a slurry of ground tobacco particles in a binder, a movable support 102, a casting blade 103 and an actuator 119.

Movable support 102 includes an endless conveyor belt 104 and a roller 105. Conveyor belt 104 has an upper surface 106.

Roller 105 rotates in the sense indicated by arrow 107 and moves conveyor belt 104 along a casting direction indicated by arrow 108.

Casting blade 103 extends along a dominant direction indicated by arrow 111, has an edge 109 including a corrugated portion 110 and is adapted to cast the slurry contained in the casting box 101 onto the surface 106 of the conveyor belt 104 of the movable support 102 along the casting direction 108 so as to form the cast web 200 of a material containing alkaloids.

Actuator 119 is coupled to casting blade 103 and changes the position of casting blade 103 along a direction parallel to dominant direction 111 and orthogonal to casting direction 108.

In the apparatus 100 represented in FIG. 1, the corrugated portion 110 of edge 109 of the casting blade 103 faces upper surface 106 of movable support 102.

Figure 2:
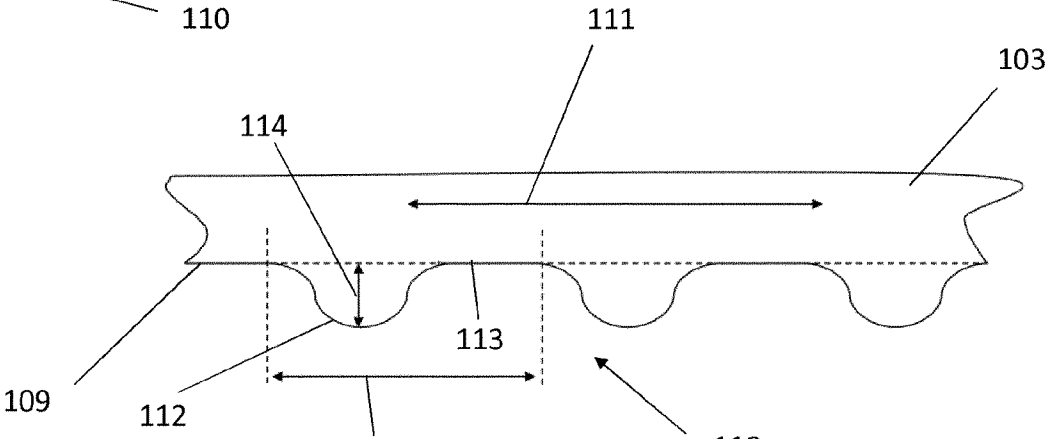
FIG. 2 is a front schematic partial view of a casting blade of an apparatus for the production of a cast web of a material containing alkaloids is shown.
Figure 3:
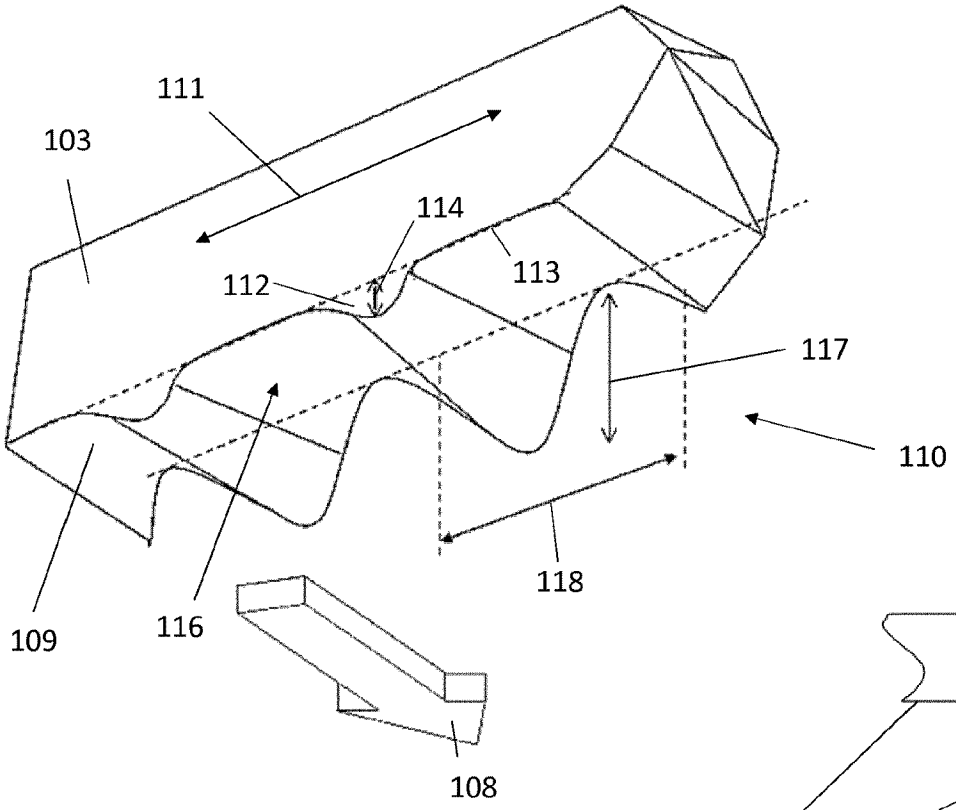
FIG. 3 is a perspective schematic partial view of a partial cross-section of a casting blade of an apparatus for the production of a cast web of a material containing alkaloids.

In FIGS. 2 and 3, a front schematic partial view and a perspective schematic partial view, respectively, of casting blade 103 of apparatus 100 for the production of a cast web 200 of a material containing alkaloids are shown.

In FIG. 2, corrugated portion 110 includes a plurality of ridges and troughs, including ridge 112 and the corresponding paired trough 113. Ridge 112 extends outwardly in a direction orthogonal to the surface defined by edge 109 and orthogonally to the dominant direction 111.

Ridge 112 has an amplitude 114 and a pitch 115. As shown in FIG. 3, ridge 112 has an amplitude 114 that monotonously increases along casting direction 108.

As shown in FIG. 3, corrugated portion 110 defines a channel 116 extending along casting direction 108, which has a depth 117 and a width 118 (distance between two "tips" of two adjacent ridges). Depth 117 increases along casting direction 108 and width 118 decreases along casting direction 108.

Figure 4:
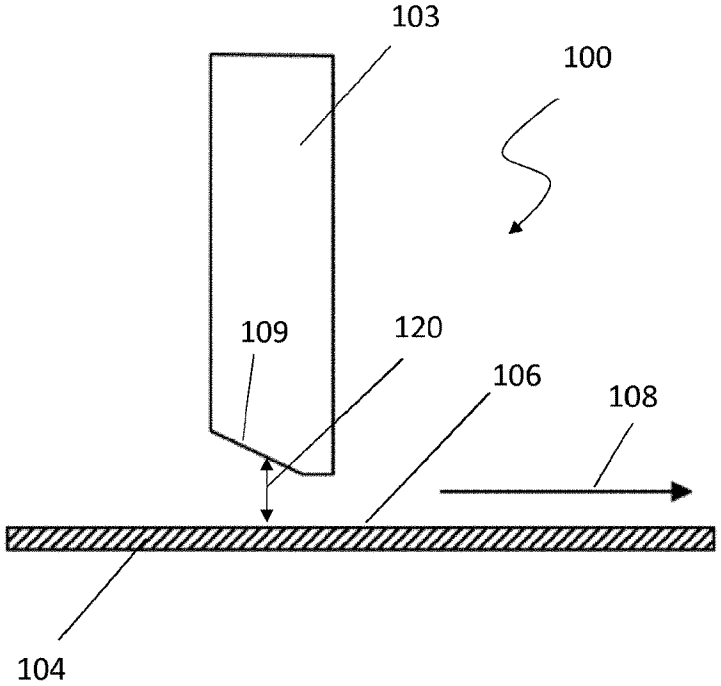
FIG. 4 is a schematic partial cross section of an apparatus for the production of a cast web of a material containing alkaloids.

In FIG. 4, a schematic partial cross section of apparatus 100 for the production of cast web 200 is shown.

In FIG. 4, edge 109 of cast blade 103 defines with the surface 106 of movable support 102 a distance 120. Distance 120 decreases along casting direction 108.

Figure 5:
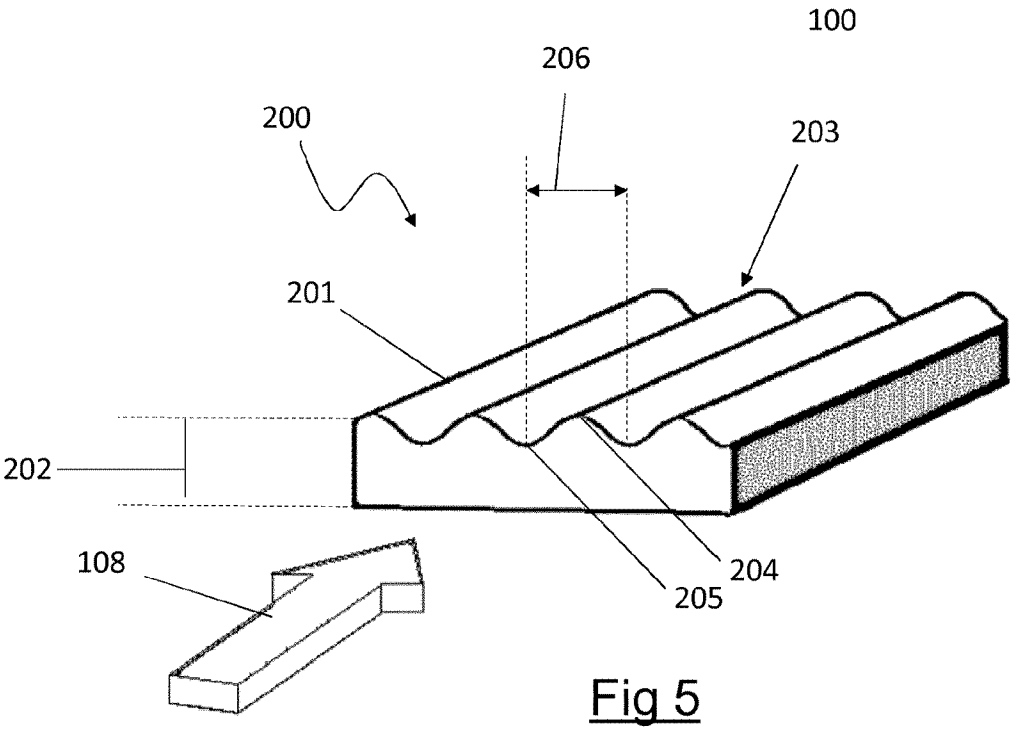
FIG. 5 is a perspective schematic partial view of a cast web of a material containing alkaloids.

In FIG. 5 a perspective schematic partial view of cast web 200 is shown. Cast web 200 has a free surface 201 and a thickness 202. Cast web 200 is of a material containing alkaloids, for example a homogenized tobacco material, and has a water content comprised from about 20 percent to about 80 percent by weight of the web.

Free surface 201 has a corrugated portion 203 including ridge 204 and a paired trough 205 extending in a direction orthogonal to thickness 202 and parallel to casting direction 108. Preferably, ridge 204 has a pitch 206 preferably comprised between about 0.2 millimeters and about 2 millimeters.

In FIG. 5, the relative dimensions of ridge 204, trough 205, thickness 202 and pitch 206 are illustrated magnified for a better appreciation and are not therefore necessarily to scale.

Figure 6:
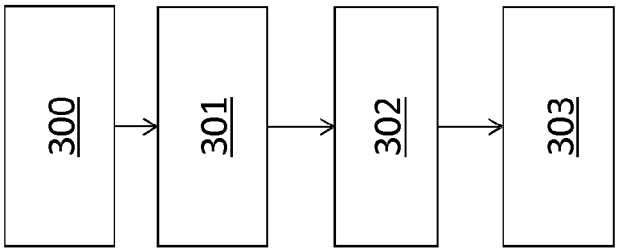
FIG. 6 shows a flow diagram of a method of the invention to produce a cast web of a material containing alkaloids.

In FIG. 6, a flow diagram of a method of the invention to produce a cast web 200 of a material containing alkaloids is shown.

A first step 300 of the method of the invention is the provision of a slurry of a material containing alkaloids. Material containing alkaloids to be used in the method of the invention preferably includes a homogenized tobacco material.

The method includes a further step 301 in which the slurry is fed to a casting box 101, adapted to contain the slurry.

Further, the method of the invention includes a step 302 of casting the slurry contained in casting box 101 by means of a casting blade 103 along a casting direction 108 onto a movable support 102 so as to form the cast web 200 of a homogenized tobacco material. In the method of the invention casting blade 103 includes a corrugated portion 110 facing a surface 106 of the movable support 102.

Further, the method of the invention includes a step 303 in which a plurality of corrugations are formed onto the cast sheet 200 by means of the corrugated portion 110 of a casting blade 103. Preferably, the corrugations include a ridge 204 and a trough 205. Preferably, ridge 204 has a pitch 206 preferably comprised between about 0.2 millimeters and about 2 millimeters.

The invention claimed is:

1. A casting apparatus for production of a cast web of a material containing alkaloids, said casting apparatus including:

a casting box adapted to contain a slurry;

a movable support having a surface and moving along a casting direction;

a casting blade, adapted to cast the slurry contained in the casting box onto the surface of the movable support along the casting direction so as to form the cast web of a material containing alkaloids;

wherein the casting blade includes a corrugated portion.

2. The casting apparatus according to claim 1, wherein the corrugated portion of the casting blade faces the surface of the movable support.

3. The casting apparatus according to claim 1, wherein the corrugated portion includes ridges or troughs.

4. The casting apparatus according to claim 3, wherein the ridges or troughs extend in a direction orthogonal to a dominant dimension of the casting blade.

5. The casting apparatus according to claim 3, wherein an amplitude of the ridges or troughs is variable along the casting direction.

6. The casting apparatus according to claim 5, wherein the amplitude of the ridges monotonously increases along the casting direction.

7. The casting apparatus according to claim 3, wherein the ridges or troughs have a pitch comprised between about 0.2 millimeters and about 4 millimeters.

8. The casting apparatus according to claim 1 when dependent on claim 2, wherein a distance between a lowest point of the corrugated portion of the casting blade and the surface of the movable support facing the casting blade decreases along the casting direction.

9. The casting apparatus according to claim 1, wherein the corrugated portion defines a plurality of channels extending along the casting direction.

10. The casting apparatus according to claim 9, wherein a depth of the channels increases along the casting direction.

11. The casting apparatus according to claim 9, wherein a width of the channels decreases along the casting direction.

12. A method for producing a cast web of a material containing alkaloids, comprising:

providing a slurry of the material containing alkaloids;

feeding the slurry to a casting box adapted to contain the slurry;

casting the slurry contained in the casting box by means of a casting blade along a casting direction onto a movable support so as to form the cast web of a material containing alkaloids, wherein the casting blade includes a corrugated portion facing a surface of the movable support; and forming a plurality of corrugations onto the cast web by means of the corrugated portion of the casting blade.

13. The method according to claim 12, wherein the step of forming the plurality of corrugations includes forming a plurality of ridges or troughs.

14. A web of a material containing alkaloids having a free surface including a corrugated portion, wherein the corrugated portion includes ridges or troughs extending in a direction orthogonal to a thickness of the web and having a pitch comprised between about 0.2 millimeters and about 2 millimeters, and wherein the web has a water content comprised from about 20 percent to about 80 percent by weight of the web.

15. The web of a material containing alkaloids according to claim 14, wherein the corrugated portion includes ridges or troughs extending in a direction orthogonal to the thickness of the web.

* * * * *